US010094548B2

(12) United States Patent
Draper et al.

(10) Patent No.: US 10,094,548 B2
(45) Date of Patent: Oct. 9, 2018

(54) HIGH EFFICIENCY LED LAMP

(75) Inventors: Charles Draper, Apex, NC (US); Kurt Wilcox, Libertyville, IL (US); Jason Taylor, Cary, NC (US); Paul Kenneth Pickard, Morrisville, NC (US); Gerald H. Negley, Chapel Hill, NC (US); Mark Edmond, Raleigh, NC (US)

(73) Assignee: Cree, Inc., Durham, NC (US)

( * ) Notice: Subject to any disclaimer, the term of this patent is extended or adjusted under 35 U.S.C. 154(b) by 177 days.

(21) Appl. No.: 13/561,874

(22) Filed: Jul. 30, 2012

(65) Prior Publication Data

US 2013/0051002 A1 Feb. 28, 2013

Related U.S. Application Data

(63) Continuation-in-part of application No. 13/190,661, filed on Jul. 26, 2011, now Pat. No. 9,797,589, which
(Continued)

(51) Int. Cl.
*F21V 9/00* (2018.01)
*F21V 29/00* (2015.01)
(Continued)

(52) U.S. Cl.
CPC ..... *F21V 29/006* (2013.01); *F21K 9/232* (2016.08); *F21V 3/02* (2013.01); *F21V 3/06* (2018.02);
(Continued)

(58) Field of Classification Search
CPC ..... F21V 3/0427; F21V 3/0445; H05B 33/10
(Continued)

(56) References Cited

U.S. PATENT DOCUMENTS 3,581,162 A 5/1971 Wheatley
5,463,280 A 10/1995 Johnson
(Continued)

FOREIGN PATENT DOCUMENTS

CN 1993581 A 7/2007
CN 101617405 A 12/2009
(Continued)

OTHER PUBLICATIONS

U.S. Appl. No. 13/103,303, filed May 9, 2011.
(Continued)

*Primary Examiner* — Christopher Raabe
(74) *Attorney, Agent, or Firm* — Dennis J. Williamson; Moore & Van Allen PLLC

(57) ABSTRACT

A high-efficiency LED lamp is disclosed. Embodiments of the invention provide a high-efficiency, high output solid-state lamp. The lamp includes an LED assembly, an optical element disposed to receive light from the LED assembly, and an optical overlay. The optical element includes a primary exit surface, wherein the primary exit surface is at least about 1.5 inches from the LED assembly. In example embodiments, the optical element is roughly cylindrical in shape, but can take other shapes and be made from various materials. An LED lamp according to some embodiments of the invention has an efficiency of at least about 160 lumens per watt. In some embodiments, the lamp has a light output of at least 1200 lumens. In some embodiments, the LED lamp produces light with a color rendering index (CRI) of at least 90 and a warm white color.

18 Claims, 14 Drawing Sheets

Related U.S. Application Data is a continuation-in-part of application No. 13/103,303, filed on May 9, 2011, now Pat. No. 8,833,980.

(51) Int. Cl.

| | |
|---|---|
| ***F21V 29/77*** | (2015.01) |
| ***F21V 3/02*** | (2006.01) |
| ***H05B 33/08*** | (2006.01) |
| ***F21K 9/232*** | (2016.01) |
| ***F21V 3/06*** | (2018.01) |
| *F21K 9/90* | (2016.01) |
| *F21V 29/58* | (2015.01) |
| *F21Y 105/12* | (2016.01) |
| *F21Y 105/10* | (2016.01) |
| *F21Y 115/10* | (2016.01) |
| *F21Y 113/13* | (2016.01) |

(52) U.S. Cl.

CPC ..... *F21V 29/004* (2013.01); *F21V 29/77* (2015.01); *H05B 33/0845* (2013.01); *H05B 33/0857* (2013.01); *F21K 9/90* (2013.01); *F21V 29/58* (2015.01); *F21V 29/773* (2015.01); *F21Y 2105/10* (2016.08); *F21Y 2105/12* (2016.08); *F21Y 2113/13* (2016.08); *F21Y 2115/10* (2016.08)

(58) Field of Classification Search

USPC ..... 362/249.02

See application file for complete search history.

(56) References Cited

U.S. PATENT DOCUMENTS

| | | | | |
|---|---|---|---|---|
| 5,561,346 | A | 10/1996 | Byrne | |
| 5,585,783 | A | 12/1996 | Hall | |
| 5,655,830 | A | 8/1997 | Ruskouski | |
| 5,688,042 | A | 11/1997 | Madadi et al. | |
| 5,806,965 | A | 9/1998 | Deese | |
| 5,947,588 | A | 9/1999 | Huang | |
| 5,949,347 | A | 9/1999 | Wu | |
| 6,220,722 | B1 | 4/2001 | Begemann | |
| 6,227,679 | B1 | 5/2001 | Zhang et al. | |
| 6,234,648 | B1 | 5/2001 | Borner et al. | |
| 6,250,774 | B1 | 6/2001 | Begemann et al. | |
| 6,276,822 | B1 | 8/2001 | Bedrosian et al. | |
| 6,465,961 | B1 | 10/2002 | Cao | |
| 6,523,978 | B1 | 2/2003 | Huang | |
| 6,550,953 | B1 | 4/2003 | Ichikawa et al. | |
| 6,621,211 | B1 * | 9/2003 | Srivastava et al. | 313/503 |
| 6,634,770 | B2 | 10/2003 | Cao | |
| 6,659,632 | B2 | 12/2003 | Chen | |
| 6,709,132 | B2 | 3/2004 | Ishibashi | |
| 6,803,607 | B1 | 10/2004 | Chan et al. | |
| 6,848,819 | B1 | 2/2005 | Arndt et al. | |
| 6,864,513 | B2 | 3/2005 | Lin et al. | |
| 6,948,829 | B2 | 9/2005 | Verdes et al. | |
| 6,982,518 | B2 | 1/2006 | Chou et al. | |
| 7,048,412 | B2 | 5/2006 | Martin et al. | |
| 7,080,924 | B2 | 7/2006 | Tseng et al. | |
| 7,086,756 | B2 | 8/2006 | Maxik | |
| 7,086,767 | B2 | 8/2006 | Sidwell et al. | |
| 7,144,135 | B2 | 12/2006 | Martin et al. | |
| 7,165,866 | B2 | 1/2007 | Li | |
| 7,172,314 | B2 | 2/2007 | Currie et al. | |
| 7,213,940 | B1 | 5/2007 | Van De Ven et al. | |
| 7,354,174 | B1 | 4/2008 | Yan | |
| 7,396,142 | B2 | 7/2008 | Laizure, Jr. et al. | |
| 7,600,882 | B1 | 10/2009 | Morejon et al. | |
| D620,624 | S | 6/2010 | Wang et al. | |
| 7,726,836 | B2 | 6/2010 | Chen | |
| 7,824,065 | B2 | 11/2010 | Maxik | |
| 7,922,356 | B2 | 4/2011 | Maxik et al. | |
| 7,965,023 | B1 | 6/2011 | Liang | |
| 8,021,025 | B2 | 9/2011 | Lee | |
| 8,253,316 | B2 | 8/2012 | Sun et al. | |
| 8,272,762 | B2 | 9/2012 | Maxik et al. | |
| 8,274,241 | B2 | 9/2012 | Guest et al. | |
| 8,277,082 | B2 | 10/2012 | Dassanayake et al. | |
| 8,282,249 | B2 | 10/2012 | Liang et al. | |
| 8,282,250 | B1 | 10/2012 | Dassanayake et al. | |
| 8,292,468 | B2 | 10/2012 | Narendran et al. | |
| 8,322,896 | B2 | 12/2012 | Falicoff et al. | |
| 8,324,790 | B1 * | 12/2012 | Hu | F21V 3/02 313/110 |
| 8,371,722 | B2 | 2/2013 | Carroll | |
| 8,400,051 | B2 | 3/2013 | Hakata et al. | |
| 8,415,865 | B2 | 4/2013 | Liang et al. | |
| 8,421,320 | B2 | 4/2013 | Chuang | |
| 8,421,321 | B2 | 4/2013 | Chuang | |
| 8,421,322 | B2 | 4/2013 | Carroll et al. | |
| 8,427,037 | B2 | 4/2013 | Liang et al. | |
| 8,449,154 | B2 | 5/2013 | Uemoto et al. | |
| 8,502,468 | B2 | 8/2013 | Li et al. | |
| 8,556,465 | B2 | 10/2013 | Lee et al. | |
| 8,641,237 | B2 | 2/2014 | Chuang | |
| 8,653,723 | B2 | 2/2014 | Cao et al. | |
| 8,696,168 | B2 | 4/2014 | Li et al. | |
| 8,740,415 | B2 | 6/2014 | Wheelock | |
| 8,750,671 | B1 | 6/2014 | Kelly et al. | |
| 8,752,984 | B2 | 6/2014 | Lenk et al. | |
| 8,760,042 | B2 | 6/2014 | Sakai et al. | |
| 2003/0012018 | A1 | 1/2003 | Kluth | |
| 2004/0070014 | A1 | 4/2004 | Lin et al. | |
| 2004/0201990 | A1 | 10/2004 | Meyer | |
| 2005/0135079 | A1 | 6/2005 | Yin Chua et al. | |
| 2007/0267642 | A1 | 11/2007 | Erchak et al. | |
| 2009/0184618 | A1 | 7/2009 | Hakata et al. | |
| 2010/0124243 | A1 | 5/2010 | Hussell et al. | |
| 2010/0254129 | A1 | 10/2010 | Le Toquin et al. | |
| 2011/0026264 | A1 | 2/2011 | Reed et al. | |
| 2011/0157901 | A1 * | 6/2011 | Chen | F21V 17/164 362/373 |
| 2011/0170289 | A1 * | 7/2011 | Allen et al. | 362/235 |
| 2011/0309735 | A1 * | 12/2011 | Parker | F21V 3/02 313/46 |
| 2012/0014116 | A1 * | 1/2012 | Hu | F21V 5/04 362/335 |
| 2012/0040585 | A1 | 2/2012 | Huang | |

FOREIGN PATENT DOCUMENTS

| | | | |
|---|---|---|---|
| EP | 1058221 | A2 | 12/2000 |
| EP | 0890059 | B1 | 6/2004 |
| GB | 2345954 | A | 7/2000 |
| JP | H09265807 | A | 10/1997 |
| JP | 2000173304 | A | 6/2000 |
| JP | 2001118403 | A | 4/2001 |
| WO | 0124583 | A1 | 4/2001 |
| WO | 0160119 | A2 | 8/2001 |
| WO | 2006016324 | A1 | 2/2006 |
| WO | 2012011279 | A1 | 1/2012 |
| WO | 2012031533 | A1 | 3/2012 |

OTHER PUBLICATIONS

American National Standard, ANSI C78.20/2003 for electric lamps, A, G, PS, and Similar Shapes with E26 Screw Bases, Oct. 30, 2003, 48 pages.

U.S. Department of Energy, Bright Tomorrow Lighting Competition (L Prize™), Jun. 26, 2009, Revision 1, 18 pages.

U.S. Appl. No. 13/081,013, filed Jan. 31, 2011.

U.S. Appl. No. 13/312,518, filed Dec. 6, 2011.

Cree, Inc., International Application No. PCT/US2012/036731, International Search Report and Written Opinion, dated Oct. 25, 2012.

Cree, Inc., Chinese Application No. 201280033937.8, First Office Action, dated Oct. 28, 2014.

Chinese Patent Office; Chinese Office Action for Application No. 201280033937.8 dated Jun. 16, 2015, 19 pages.

(56) References Cited

OTHER PUBLICATIONS

Chinese Patent Office; Office Action for Chinese Patent Application No. 201280033937.8 dated Sep. 14, 2015, 18 Pages.
Free, Inc., Chinese Patent Application No. 201280033937.8, Decision on Rejection, dated Feb. 16, 2016.
U.S. Appl. No. 13/190,661, Office Action, dated Apr. 1, 2013.
U.S. Appl. No. 13/190,661, Final Office Action, dated Aug. 30, 2013.
U.S. Appl. No. 13/190,661, Office Action, dated Dec. 19, 2013.
U.S. Appl. No. 13/190,661, Office Action, dated Jun. 12, 2014.
U.S. Appl. No. 13/190,661, Final Office Action, dated Sep. 30, 2014.
U.S. Appl. No. 13/190,661, Office Action, dated Dec. 29, 2014.
U.S. Appl. No. 13/190,661, Final Office Action, dated Jul. 2, 2015.
U.S. Appl. No. 13/190,661, Office Action, dated Dec. 18, 2015.
U.S. Appl. No. 13/190,661, Office Action, dated Jun. 14, 2016.
Chinese Patent Office; Notice of Reexamination for Chinese Patent Application No. 201280033937.8 dated Sep. 18, 2016, 19 Pages.
Chinese Patent Office; Reexamination Decision for Chinese Patent Application No. 201280033937.8 dated Feb. 9, 2017, 19 Pages.
USPTO; Non-Final Office Action for U.S. Appl. No. 13/190,661 dated Jan. 26, 2017, 17 Pages.

* cited by examiner

HIGH EFFICIENCY LED LAMP

CROSS-REFERENCE TO RELATED APPLICATIONS

This application is a continuation-in-part of and claims priority from commonly-owned, co-pending U.S. application Ser. No. 13/190,661 filed Jul. 26, 2011, which is in turn a continuation-in-part and claims priority from commonly-owned, co-pending U.S. application Ser. No. 13/103,303, filed May 9, 2011. The entire disclosures of both of these related applications are incorporated herein by reference.

BACKGROUND

Light emitting diode (LED) lighting systems are becoming more prevalent as replacements for existing lighting systems. LEDs are an example of solid state lighting (SSL) and have advantages over traditional lighting solutions such as incandescent and fluorescent lighting because they use less energy, are more durable, operate longer, can be combined in red-blue-green arrays that can be controlled to deliver virtually any color light, and contain no lead or mercury.

In many applications, one or more LED dies (or chips) are mounted within an LED package or an LED module, which may make up part of a lighting fixture which includes one or more power supplies to power the LEDs. Some lighting fixtures include multiple LED modules. A module or strip of a fixture includes a packaging material with metal leads (to the LED dies from outside circuits), a protective housing for the LED dies, a heat sink, or a combination of leads, housing and heat sink. An LED fixture may be made with a form factor that allows it to replace a standard threaded incandescent bulb, or any of various types of fluorescent or halogen lamps. LED fixtures and lamps often include some type of optical elements external to the LED modules themselves. Such optical elements may allow for localized mixing of colors, collimate light, and/or provide a controlled beam angle.

Color reproduction can be an important characteristic of any type of artificial lighting, including LED lighting. For lamps, color reproduction is typically measured using the color rendering index (CRI). The CRI is a relative measurement of how the color rendition of an illumination system compares to that of a particular known source of light. In more practical terms, the CRI is a relative measure of the shift in surface color of an object when lit by a particular lamp. The CRI equals 100 if the color coordinates of a set of test surfaces being illuminated by the lamp are the same as the coordinates of the same test surfaces being irradiated by the known source. CRI is a standard for a given type light or light from a specified type of source with a given color temperature. A higher CRI is desirable for any type of replacement lamp.

In some locales, government, non-profit and/or educational entities have established standards for SSL products, and provided incentives such as financial investment, grants, loans, and/or contests in order to encourage development and deployment of SSL products meeting such standards to replace common lighting products currently used. For example, in the United States, the Bright Tomorrow Lighting Competition (L Prize™) has been authorized by the Energy Independence and Security Act of 2007 (EISA). One version of the specification for the L Prize is described in *Bright Tomorrow Lighting Competition* (*L Prize*™), Jun. 26, 2009, Document No. 08NT006643, the disclosure of which is hereby incorporated herein by reference. The L Prize is awarded for various categories of lighting products. One recently authorized category of lamp authorized for L Prize consideration is a very high efficiency, bright lamp, for which no particular form factor is required.

SUMMARY

Embodiments of the present invention provide a high-efficiency, high output solid-state lamp. The lamp can include an LED assembly and an optical element disposed to receive light from the LED assembly. The optical element includes a primary exit surface for the light, wherein at least a portion of the primary exit surface is spaced apart from the LED assembly. In example, embodiments, the optical element is roughly cylindrical, cylindrical, or frustoconical in shape, so that a large percentage of light from the LED assembly strikes curved walls of the optical element at an oblique angle and exits the fixture through the primary exit surface of the optical element. In some embodiments, the lamp includes an optical overlay or optical overlays to improve its efficiency.

An LED lamp according to some embodiments of the invention has a light output of at least 1200 lumens. In some embodiments, the lamp has a light output of from about 1200 to about 1400 lumens. In some embodiments, the lamp has an efficiency of at least about 160 lumens per watt, and may have an efficiency of at least about 165, at least about 170 or at least about 175 lumens per watt. In some embodiments, the lamp has an efficiency of between about 165 and about 180 lumens per watt. In some embodiments, the lamp has an efficiency of between about 165 and about 175 lumens per watt. In some embodiments, the LED lamp produces light with a color rendering index (CRI) of at least 90. In some embodiments, the lamp produces warm white light. In some embodiments, the lamp produces light with a correlated color temperature of from 2500 to 3500 K. In some embodiments, the lamp produces light with a correlated color temperature of from 2900 to 3300 K.

In some embodiments, the primary exit surface for the optical element of the lamp is about 1.5 inches from the LED assembly of the lamp. In some embodiments, the primary exit surface or a portion of the primary exit surface is spaced from about 1.5 to about 8 inches away from the LED assembly. Various embodiments can include an optical element with various shapes, including cylindrical, spherical, bullet and a frustoconical shapes. The optical element may be or serve as a diffuser. In some embodiments, the lamp includes an optical overlay adjacent to the optical element and the LED assembly. In at least some embodiments of the invention, the lamp includes a power supply portion including a power supply electrically connected to the LED assembly. In some embodiments, the power supply portion of the lamp includes an Edison base. In some embodiments, the lamp includes a GU24 type base with two pins. In some embodiments, the lamp includes a heatsink adjacent to the optical overlay. The heatsink may have a plurality of substantially white fins. In some embodiments, the optical overlay of the lamp includes a substantially white reflective surface.

The lamp can be assembled by providing the LED assembly, connecting the LED assembly to the power supply, providing a heatsink in thermal communication with at least one of the LED assembly and the power supply, installing the optical overlay, and installing the optical element so as to receive light from the LED assembly. The power supply enables a lamp or light source that is powered by line voltage, for example 110 or 220 volts AC. In some embodiments, the LED assembly of the lamp includes a plurality of red-emitting LED devices and a plurality of blue-shifted-yellow (BSY) emitting LED devices. In some embodiments, the LED assembly includes at least 12 of each. In some embodiments, the LED assembly of the lamp includes 13 of the red-emitting LED devices and 31 of the BSY-emitting LED devices.

In some embodiments of the lamp, the LED assembly is constructed to include at least two LEDs or groups of LEDs, wherein one LED or group, when illuminated, emits light having a dominant wavelength from 435 to 490 nm, and another LED or group, when illuminated, emits light having a dominant wavelength from 600 to 640 nm. One LED or group of LEDs is packaged with a phosphor, which, when excited, emits light having a dominant wavelength from 540 to 585 nm. In some embodiments, the first and second LEDs or groups of LEDs emit light having a dominant wavelength from 440 to 480 nm, and a dominant wavelength of about 610 nm, respectively and the phosphor, when excited, emits light having a dominant wavelength from 560 to 580 nm.

BRIEF DESCRIPTION OF THE DRAWINGS

FIG. 2 shows the power supply portion and the LED assembly of a lamp.

FIG. 6 illustrates a number of optional features of an LED lamp according to example embodiments of the invention.

FIG. 13 shows the power supply portion and the LED assembly of a lamp from a perspective of looking down on the LED assembly and optical overlay with the optical element removed.

DETAILED DESCRIPTION

Figure 1:
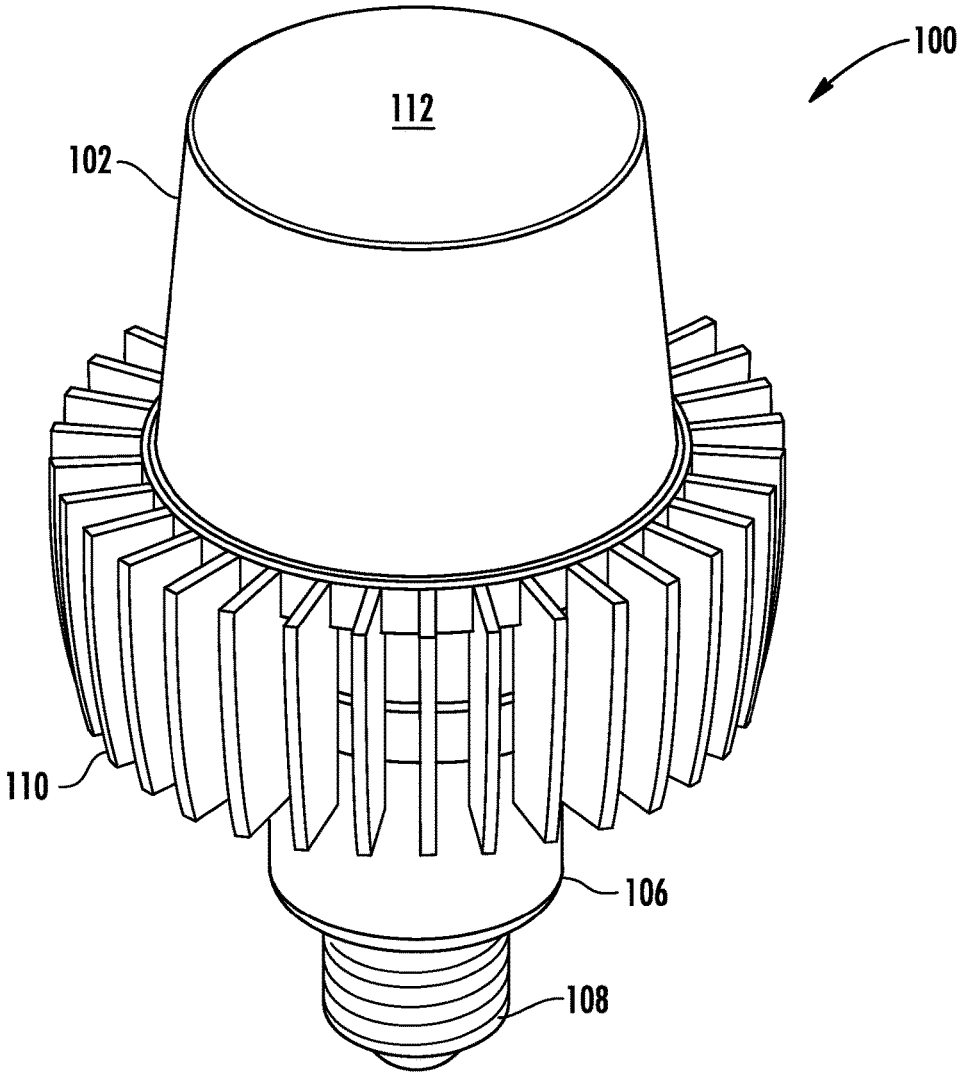
FIG. 1 is a perspective view of an LED lamp according to example embodiments of the present invention.

Embodiments of the present invention now will be described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present invention. As used herein, the term "and/or" includes any and all combinations of one or more of the associated listed items.

It will be understood that when an element such as a layer, region or substrate is referred to as being "on" or extending "onto" another element, it can be directly on or extend directly onto the other element or intervening elements may also be present. In contrast, when an element is referred to as being "directly on" or extending "directly onto" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

Relative terms such as "below" or "above" or "upper" or "lower" or "horizontal" or "vertical" may be used herein to describe a relationship of one element, layer or region to another element, layer or region as illustrated in the figures. It will be understood that these terms are intended to encompass different orientations of the device in addition to the orientation depicted in the figures.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" "comprising," "includes" and/or "including" when used herein, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms used herein should be interpreted as having a meaning that is consistent with their meaning in the context of this specification and the relevant art and will not be interpreted in an idealized or overly formal sense unless expressly so defined herein.

Unless otherwise expressly stated, comparative, quantitative terms such as "less" and "greater", are intended to encompass the concept of equality. As an example, "less" can mean not only "less" in the strictest mathematical sense, but also, "less than or equal to."

Figure 2:
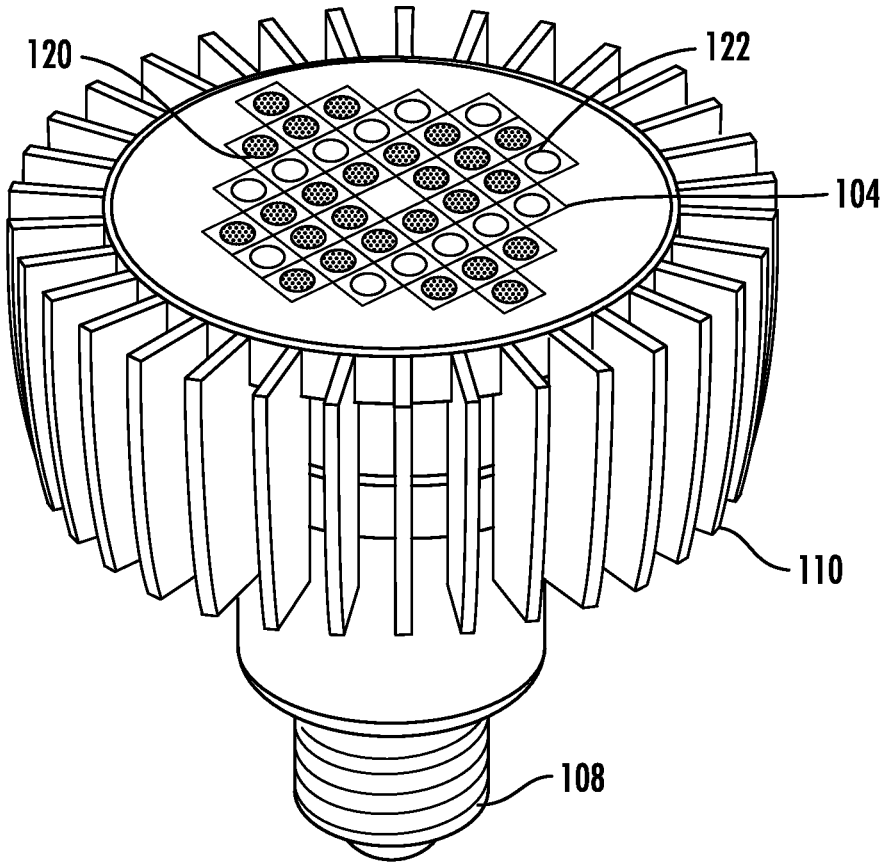
FIG. 2 is a perspective view of a partially assembled LED lamp according to example embodiments of the invention. More specifically.
Figure 3:
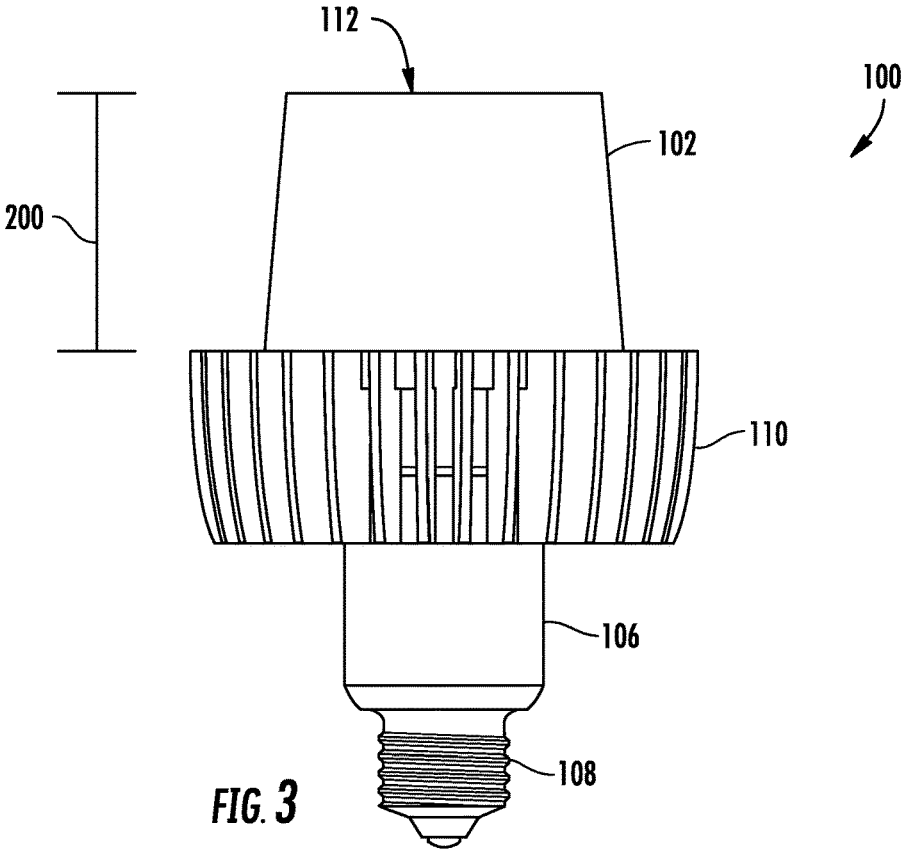
FIG. 3 is a side view of an LED lamp according to example embodiments of the present invention.
Figure 4:
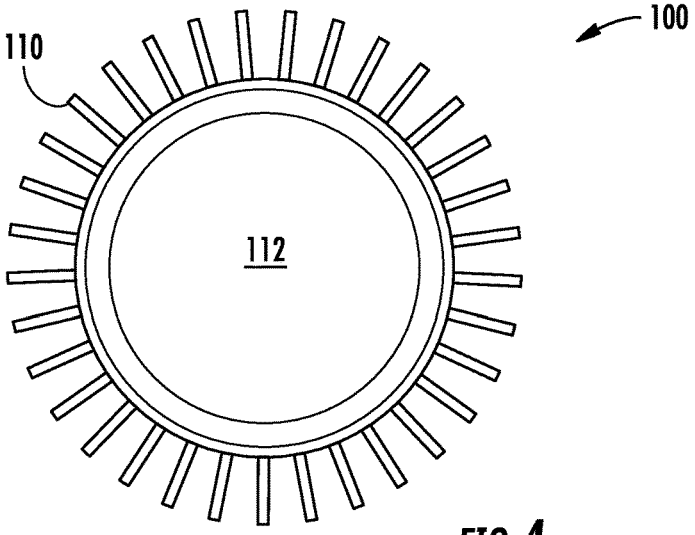
FIG. 4 is a top view of an LED lamp according to example embodiments of the present invention.

FIG. 1 shows a perspective view of an LED lamp according to example embodiments of the invention, and FIG. 2 shows a similar perspective view with the optical element removed, leaving the power supply portion with the LED assembly visible. In this illustration, the LED assembly is pictured schematically rather than realistically, so that the example layout using two different types of LEDs may be clearly shown and discussed. FIG. 3 is a side view of the lamp of FIG. 1 and FIG. 4 is a top view of the lamp. Lamp 100 includes an optical element 102 and an LED assembly 104. LED assembly 104 of the lamp has been interconnected with a power supply in power supply portion 106 of the lamp. The power supply portion 106 of the lamp includes the power supply that includes circuitry (not visible) to provide DC current to an LED assembly. To assemble the power supply portion of the lamp, the circuitry may be installed within the void in the power supply portion and potted, or covered with a resin to provide mechanical and thermal stability. The potting material fills the space within power supply portion 106 not occupied by power supply components and connecting wires.

The particular power supply portion of an LED lamp shown includes Edison base 108 and a heat sink 110. The Edison base can engage with an Edison socket so that this example LED lamp can be used in some fixtures designed for incandescent lamps. The electrical terminals of the Edison base are connected to the power supply to provide AC power to the power supply. The particular physical appearance of the power supply portion and type of base included are examples only. Numerous types of LED lamps can be created using embodiments of the invention, with various types of bases and shapes. Bulbs with Edison style bases are described in American National Standard ANSI C78.20-2003 for electric lamps, *A, G, PS, and Similar Shapes with E26 Screw Bases,* Oct. 30, 2003, which is incorporated herein by reference.

LED assembly 104 of lamp 100 further includes multiple LED modules mounted on a carrier such as a circuit board, which provides both mechanical support and electrical connections for the LEDs. In some embodiments, a vapor plate can be used as the carrier for the LED modules for improved thermal performance. For purposes of this disclosure, a flat heat pipe may also be referred to as a vapor plate. The vapor plate dissipates heat from the LEDs. LED assembly 104 in this example embodiment includes twenty-five LED packages or LED modules, in which an LED chip is encapsulated inside a package with a lens and leads. The LED modules include LEDs operable to emit light of two different colors. In this example embodiment, the LED modules 120 in LED assembly 104 in lamp 100, when illuminated, emit light having dominant wavelength from 440 to 480 nm. The LED modules 122 in LED assembly 104 in lamp 100, when illuminated, emit light having a dominant wavelength from 605 to 630 nm. In some embodiments some LEDs are packaged with a phosphor. A phosphor is a substance, which, when energized by impinging energy, emits light. In some cases, phosphor is designed to emit light of one wavelength when energized by being struck by light of a different wavelength, and so provides wavelength conversion. In the present example embodiment, one group of LEDs in LED assembly 104 is packaged with a phosphor which, when excited by light from the included LED, emits light having a dominant wavelength from 560 to 580 nm. In some embodiments of the invention, one LED or group, when illuminated, emits light having a dominant wavelength from 435 to 490 nm, and the other LED or group, when illuminated, emits light having a dominant wavelength from 600 to 640 nm. In some embodiments the phosphor, when excited, emits light having a dominant wavelength from 540 to 585 nm.

In the present embodiment, the phosphor is included in modules 120 of lamp 100. In this example, the phosphor is deposited on the encapsulating lens for each LED at such a thickness so that some of the light from the LED goes through the phosphor, while other light is absorbed and the wavelength is converted by the phosphor. Thus, each LED is packaged in a module 120 to form a blue-shifted yellow (BSY) LED device, while the light from each LED in modules 122 passes out of the LED module as red or orange (red/orange) light. Thus, substantially white light can be produced when these two colors from the modules in the LED assembly are combined. Thus, this type of LED assembly may be referred to as a BSY+R LED assembly. In the particular example shown in FIG. 2, there are 25 BSY and 13 red LED packages. The numbers of LEDs used in the LED assembly, both in total and the relative numbers of different types of LEDs, can be varied in accordance with the required size and output of the lamp and the color light desired.

In addition to a high color rendering index (CRI), light can be produced using an LED assembly like that above wherein the light in some embodiments has a white warm correlated color temperature (CCT). White warm light is light having a CCT of less than about 4000K. In some embodiments, the light from the LED lamp has a CCT from 2500K to 3500K. In other embodiments, the light can have a CCT from 2700K to 3300K. In still other embodiments, the light can have a CCT from about 2725K to about 3045K. In some embodiments, the light can have a CCT of between about 2800K and 3000K. In still other embodiments, where the light is dimmable, the CCT may be reduced with dimming. In such a case, the CCT may be reduced to as low as 1500K or even 1200K.

It should be noted that other arrangements and numbers of LEDs can be used with embodiments of the present invention. The same number of each type of LED can be used, and the LED packages can be arranged in varying patterns. A single LED of each type could be used. Additional LEDs, which produce additional colors of light, can be used. Phosphors can be used with all the LED modules. Phosphor serves as a wavelength conversion material. A single phosphor can be used with multiple LED chips and multiple LED chips can be included in one, some or all LED device packages. A remote phosphor can be used, where the optical element is coated or impregnated with phosphor particles, or an additional optical element for the purpose of providing remote wavelength conversion can be included in a lamp according to example embodiments of the invention. Quantum dots can also be distributed in or on optical elements as a remote wavelength conversion material. A further detailed example of using groups of LEDs emitting light of different wavelengths to produce substantially white light can be found in issued U.S. Pat. No. 7,213,940, which is incorporated herein by reference.

Optical element 102 of lamp 100 includes a primary exit surface 112 for light emitted from LED assembly 104. Such an optical element may also be referred to as a "dome" (notwithstanding its shape), an enclosure, or an optical enclosure. In some embodiments, optical element 102 may provide color mixing so that color hot spots do not appear in the light pattern being emitted from the lamp. Such an optical element may also provide for diffusion of light and therefore may also be referred to as a "diffuser". Such a color mixing optical element or diffuser may be frosted, painted, etched, roughened, may have a molded-in pattern, or may be treated in many other ways to provide color mixing for the lamp. The enclosure may be made of glass, plastic, or some other material that passes light.

Still referring specifically to optical element 102 of lamp 100 shown in the Figures, the optical element is cylindrical in shape. Note that by the term, "cylindrical" what is meant is simply that it has a curved surface with an end that that is at least roughly parallel to the LED mounting surface. In this example embodiment, the end serves at the primary exit surface for light from the LED assembly. The term "cylindrical" as used herein does not mean that the shape is defined precisely by the mathematical equation for a cylinder, as clearly the example optical element shown in the Figures is not. The shape of the cylindrical optical element shown for lamp 100 is a frustoconical shape, or a truncated cone, however, a perfect cylinder and any other suitable shape can be used. The surface 110 of optical element 102 serves as the primary exit surface because a large percentage of light from the LED assembly strikes curved walls of the optical element at an oblique angle and exits the fixture through the primary exit surface of the optical element.

It should be noted that, while the primary exit surface in some embodiments is substantially flat; the primary exit surface can be various shapes, including "bullet" shapes as well as spherical or conical shapes, or any other shapes. It cannot be overemphasized that all these are examples. The optical element itself can have various shapes. The optical element of an embodiment of the invention can even be completely spherical or hemispherical. In such a case, the primary exit surface may be defined by an area of higher light concentration opposite the LED assembly. In such a case, the primary exit surface can be considered spherical, since it is defined in a portion of a sphere.

Optical element 102 of lamp 100 improves the efficiency of lamp 100 by spacing primary exit surface 112 away from the source of the light. This distance, 200, is indicated in the side view of lamp 100 shown in FIG. 3. The distance required for maximum efficiency and/or light output varies depending on the area taken up by the LEDs, which is in part a function of the number of LEDs used in the lamp. In one example embodiment, the primary exit surface is spaced about three inches away from the LEDs. In some embodiments, high efficiency can be achieved with as little as 1.5 inches of spacing between the LEDs and the primary exit surface. The primary exit surface can be spaced further away without significant negative impact on the efficiency or light output. In some embodiments there may be desire to limit distance 200 for aesthetic or other reasons. An optical element used with example embodiments of the invention may for example have a primary exit surface spaced away from the LED assembly a distance of from 1.5 to eight inches, or from three to eight inches.

In example embodiments, optical element 102 serves as a diffuser and is substantially cylindrical, and less than 3 inches wide. In at least one embodiment it is about 2.75 inches wide. In some embodiments it is less than or equal to 2.5 inches wide. The diffuser can be a perfect or near perfect cylinder, or can be wider at one end, such as the bottom, as in the embodiments shown in the Figures. For example, optical element could have 3, 5 or 10 degrees of draft.

Various shapes and sizes can be used for the optical element in an embodiment of the invention, as previously discussed. The optical element can also include and anti-reflective inner coating to improve efficiency. The diffusion qualities of the optical element may vary across the surface of the optical element.

The use of a semi-rigid supported or deformable optical element has been previously discussed. Such an optical element, as well as a more rigid optical element, may be filled with an index matching fluid or liquid. With respect to the fluid medium used, as an example, a liquid, gel, or other material that is either moderate to highly thermally conductive, moderate to highly convective, or both, can be used. As used herein, a "gel" includes a medium having a solid structure and a liquid permeating the solid structure. A gel can include a liquid, which is a fluid. The term "fluid medium" is used herein to refer to gels, liquids, and any other non-gaseous, formable material. The fluid medium surrounds the LED devices in the tubular enclosure. In example embodiments, the fluid medium has low to moderate thermal expansion, or a thermal expansion that substantially matches that of one or more of the other components of the lamp. The fluid medium in at least some embodiments is also inert and does not readily decompose.

As examples, a fluid medium used in some embodiments may be a perfluorinated polyether (PFPE) liquid, or other fluorinated or halogenated liquid, or gel. The index matching medium can have the same refractive index as the material of the enclosure or the LED device package material, or the LED substrates if no packaging is used. The index matching medium can have a refractive index that is arithmetically in between the indices of two of these materials.

Embodiments of the invention can use varied fastening methods and mechanisms for interconnecting the parts of the lamp. For example, in some embodiments locking tabs and holes can be used. In some embodiments, combinations of fasteners such as tabs, latches or other suitable fastening arrangements and combinations of fasteners can be used which would not require adhesives or screws. In other embodiments, adhesives, screws, or other fasteners may be used to fasten together the various components. The optical element described with respect to the example embodiments disclosed herein can be fastened in place with thermal epoxy. Other fastening methods can be used to fasten an optical enclosure to the other parts of the lamp. As examples, enclosures can be threaded and can screw into or onto the rest of the lamp. A tab and slot or similar mechanical arrangement could be used, as could fasteners such as screws or clips. These mechanisms can be designed to allow replacement of the optical element by end-users.

A heatsink may be used that has more extended curved fins, more or fewer fins, etc. Heatsinks of various shapes and configurations may be used with an embodiment of the invention. A heatsink may be provided that has a more decorative appearance. The heatsink can be made of metal, plastic, or other material. Plastic with enhanced thermal conductivity can be used to form the heat sink. Transparent or translucent material can also be used to form a heatsink according to example embodiments of the invention.

Figure 5:
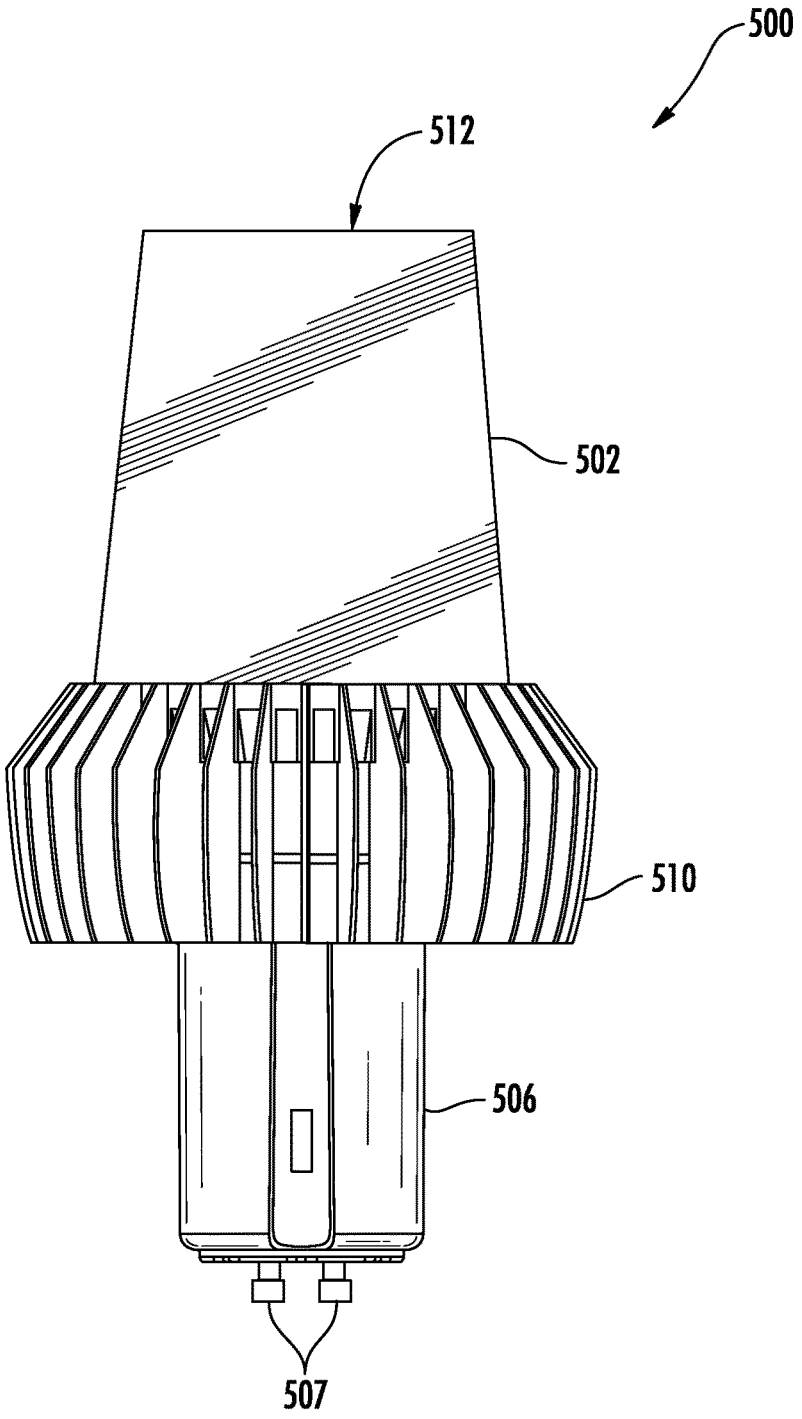
FIG. 5 is a side view of an LED lamp according to other example embodiments of the present invention. The lamp of FIG. 5 includes a longer, fluid-filled optical element and a GU24 base.
Figure 6:
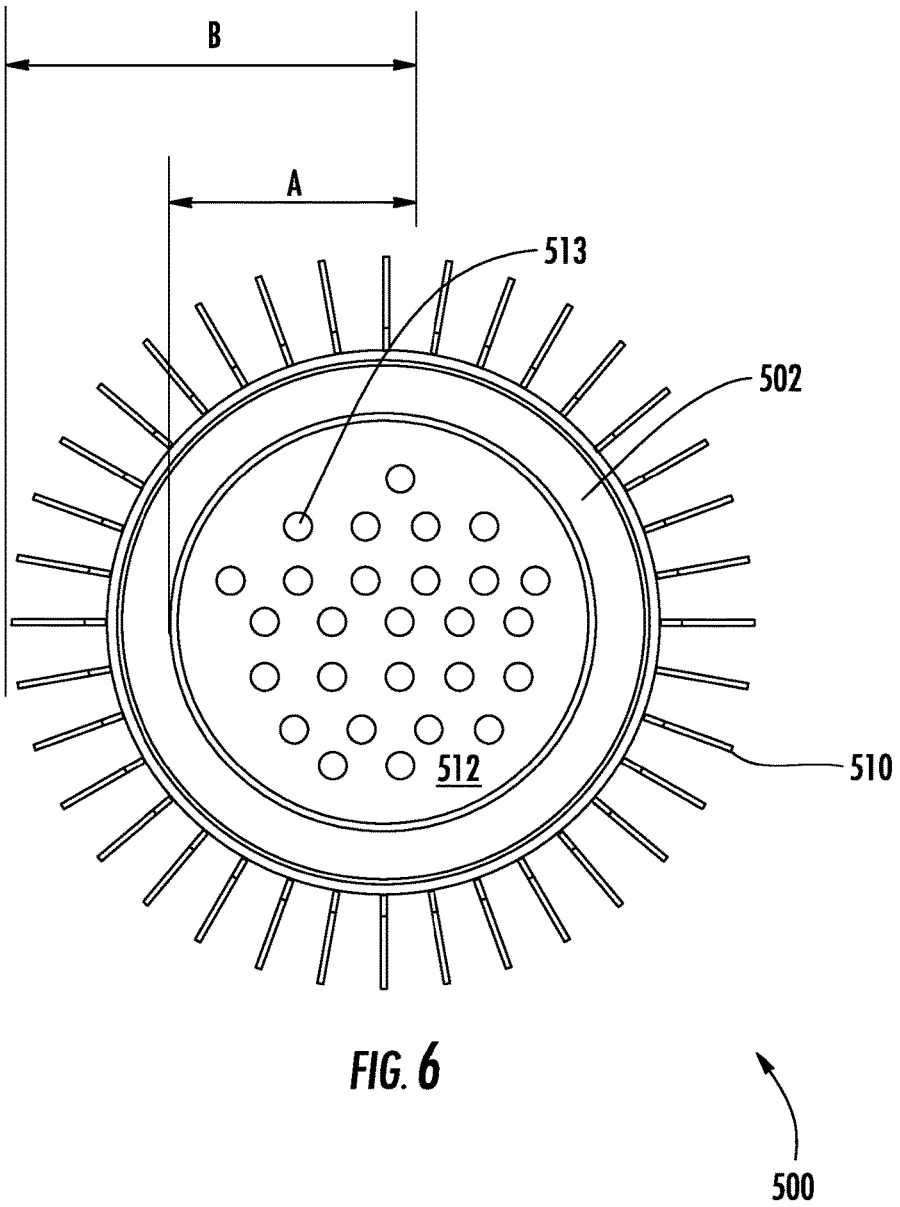
FIG. 6 is a top of the LED lamp of FIG. 5.

FIG. 5 is a side view of an LED lamp according to another embodiment of the present invention, and FIG. 6 is a top view of this lamp. Lamp 500 includes an optical element 502 and contains an LED assembly (not shown) as previously discussed. In this particular embodiment, the void within optical element 502 is filled with an optical index matching fluid as previously discussed, as indicated by the refractory marks shown in FIG. 5. The LED assembly of the lamp has been interconnected with a power supply in power supply portion 506 of the lamp. The power supply portion 506 of the lamp includes the power supply consisting of circuitry (not visible) to provide DC current to an LED assembly. The particular power supply portion of an LED lamp shown includes is formed into a GU24 type base with two connection pins 507. Pins 507 are connected to the power supply to provide AC power to the power supply. Heatsink 510 takes a slightly different form than the heatsink previously shown, with thinner fins having an angled portion near the top. The particular physical appearance of the power supply portion and type of base included are examples only.

The example LED lamp of FIG. 5 and FIG. 6 includes primary exit surface 512, which, as can be seen in FIG. 6, includes small light refracting features 513, which may be for example, multi-angled dimples or stipples, but could take many forms. FIG. 6 also illustrates possible geometrical relationships between the heatsink and optical element of example embodiments of the lamp. Diameter A is the diameter of the narrowest part of the optical element, in this case, the diameter of the primary exit surface. Diameter B is the diameter of the heatsink fin structure. It should be noted that the draft of the frustoconical diffuser of this embodiment is the same as that of the embodiment shown in FIG. 1, but since the primary exit surface 512 is spaced further away from the LED assembly, diameter A is smaller than the corresponding diameter in the embodiment of FIG. 1. In this example, the heatsink diameter is approximately 90% greater than the diameter of the smallest part of the diffuser or optical element. In the example of FIG. 1, the heatsink diameter is approximately 65% greater. In some embodiments the heatsink can be from about 50% to about 120% greater than the smallest part of the optical element or diffuser. In some embodiments, the heatsink can be from about 60% to about 95% greater than the smallest part of the optical element or diffuser. Note that since the optical element can take different shapes, these same percentages could alternatively be applied instead to the primary exit surface where that surface is not the smallest part of the optical element. As will be described in more detail with respect to FIG. 10, the primary exit surface may be closer or even the same diameter as the heatsink, thus, in such a case, the heatsink may be from 0% to, 10%, 25%, 50%, 60%, 95%, or 120% greater than the diameter of the primary exit surface of the optical element or diffuser.

Figure 7:
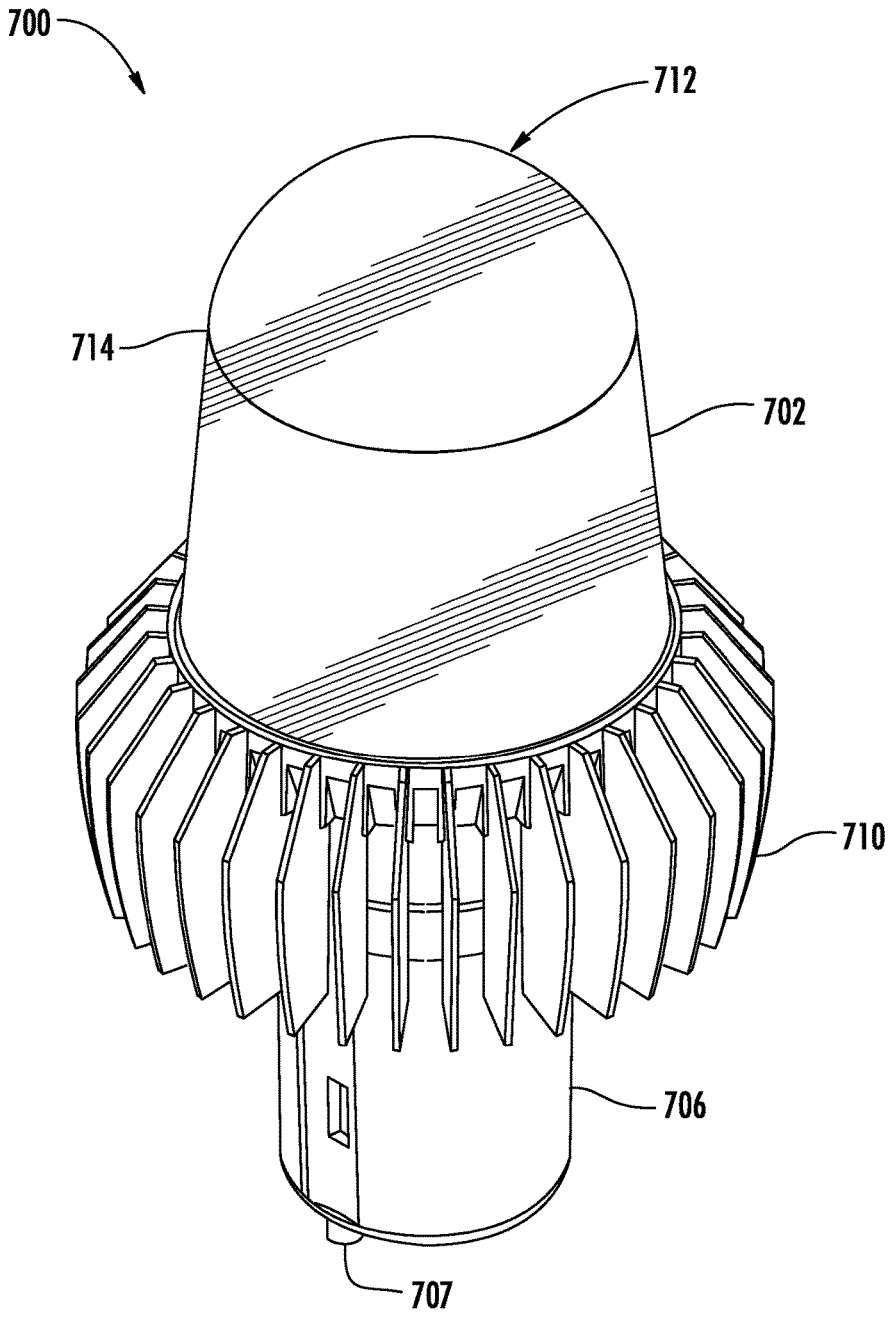
FIG. 7 is a perspective view of a lamp according to another embodiment of the invention.
Figure 8:
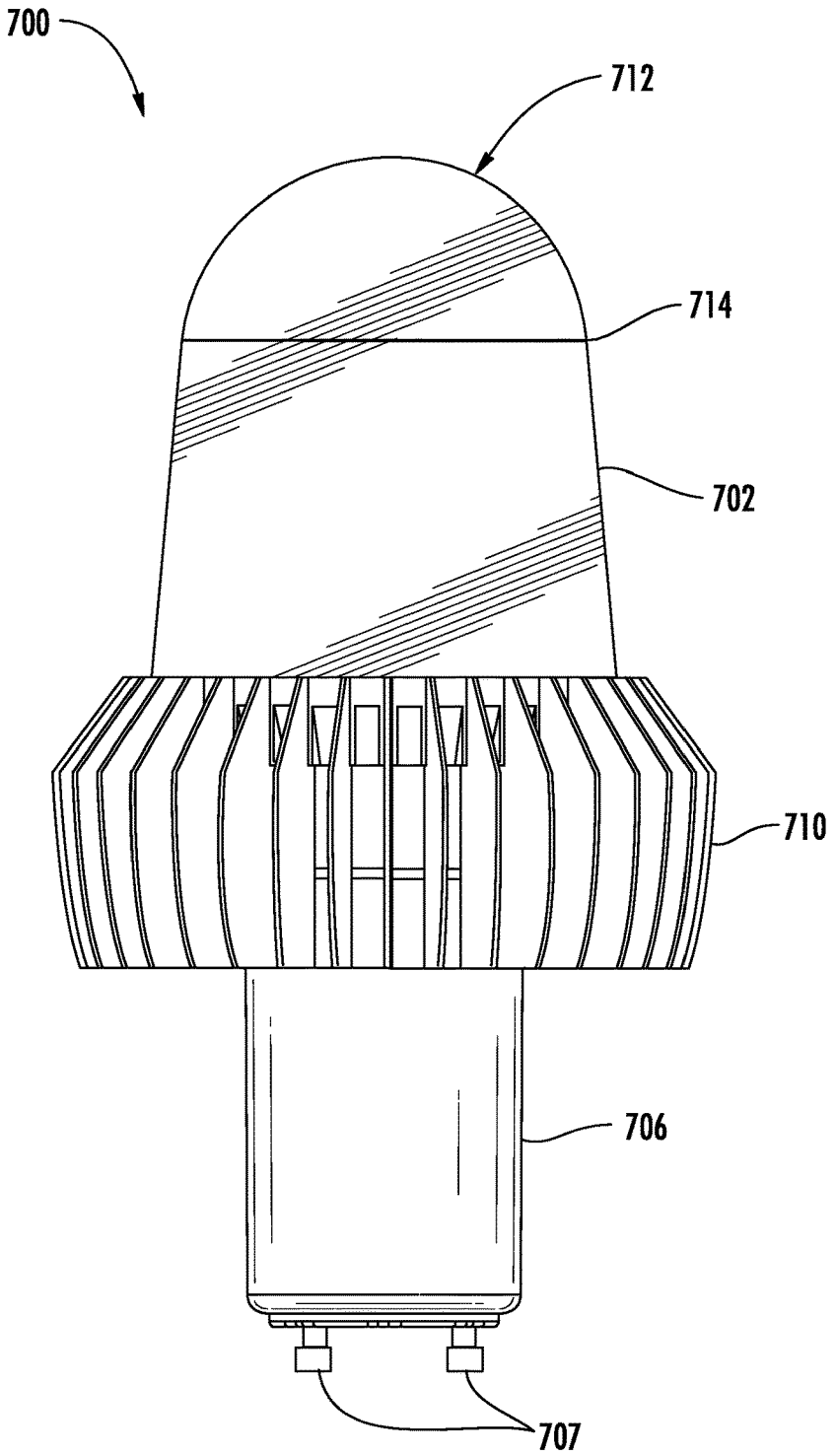
FIG. 8 is a side view of the lamp according to the embodiment pictured in FIG. 7.

FIG. 7 is a perspective view of an LED lamp according to another embodiment of the present invention, and FIG. 8 is a side view of this lamp. Lamp 700 includes an optical element 702 and contains an LED assembly to be shown in and described with respect to the exploded perspective view of FIG. 8. The LED assembly 704 of the lamp has been interconnected with a power supply in power supply portion 706 of the lamp. The power supply portion 706 of the lamp includes the power supply that includes circuitry (not visible) to provide DC current to an LED assembly. The particular power supply portion of an LED lamp shown includes a GU24 type base with two connection pins 707. Pins 707 are connected to the power supply to provide AC power to the power supply. Heatsink 710 is similar to the heatsink shown in FIG. 5 and FIG. 6.

Figure 9:
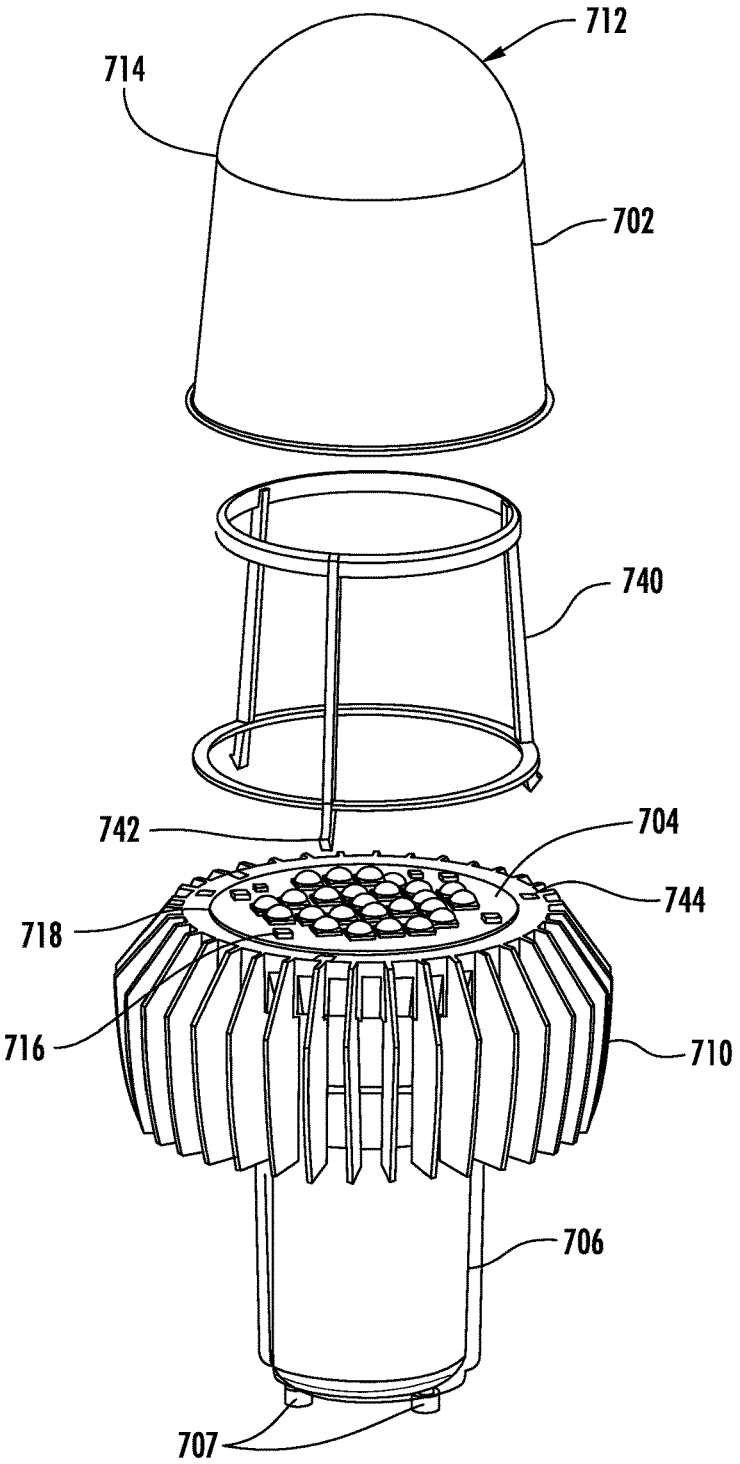
FIG. 9 is an exploded perspective view of the lamp according to the embodiment of FIG. 7 and FIG. 8. The view of FIG. 9 illustrates a number of optional features of a lamp according to example embodiments of the invention.

The example LED lamp of FIG. 7, FIG. 8 and FIG. 9 includes primary exit surface 712, which is at least approximately spherical in shape. There is a break point 714 between the spherical portion and the side portion of the optical element in this example embodiment, giving the diffuser an overall bullet shape. Many variations on these shapes can be implemented, resulting in an entire diffuser or optical element with a spherical shape or bullet shape, as well as the cylindrical, frustoconical and other shapes previously discussed. These shapes or portions of these shapes can be combined.

Turning more specifically to FIG. 9, LED assembly 704 is visible in this exploded view of LED lamp 700. In this example, the LED packages used in the LED assembly are portrayed realistically overall while some detail is omitted for clarity. The LED assembly also includes additional components 716 such as ESD diodes, capacitors, and/or the like. In this example, the LEDs are also mounted on circular plate 718, which in this example embodiment is a vapor plate to dissipate heat from the LED assembly.

Still referring to FIG. 9, optical element 702 in this embodiment is a diffuser of deformable or semi-rigid material, for example, diffuser film. Optical element 702 is supported by a rigid plastic support structure 740. This support structure includes tabs 742 which engage slots or holes 744 to snap into place. If the diffuser or optical element is fastened to support structure 740 via adhesive, mechanical fasteners, or any other fastening method, the entire diffuser assembly can be snap fit and is readily replaceable, possibly even in the field. It should be noted that this type of mechanism could be used in any optical element, including one of completely unitary construction. Other fastening techniques could achieve a similar result, for example, the optical element could screw into place.

Figure 10:
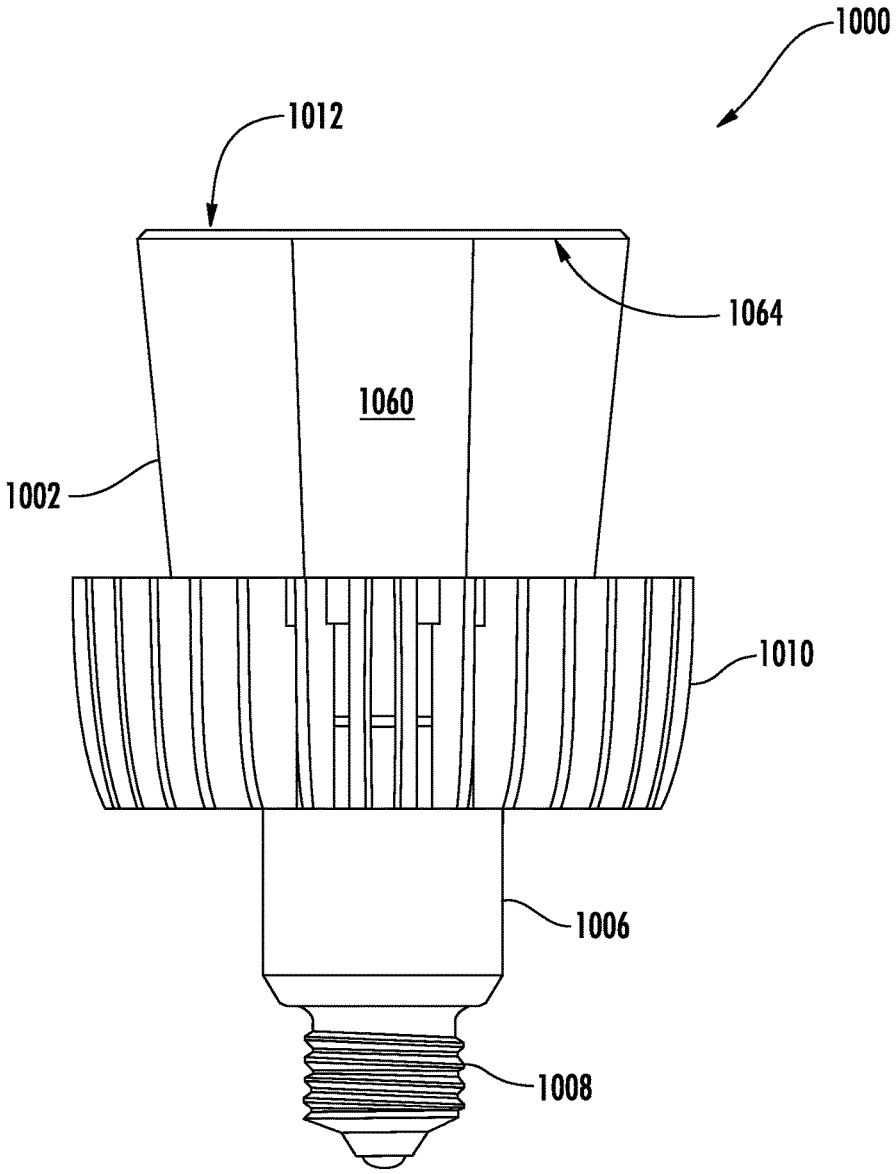
FIG. 10 is a side view of an LED lamp according to additional embodiments of the invention.

FIG. 10 is a side view of an LED lamp according to another example embodiment of the invention. Lamp 1000 includes an optical element 1002 and an LED assembly (not visible). The LED assembly is again interconnected with a power supply in power supply portion 1006 of the lamp. The particular power supply portion of LED lamp 1000 this time again includes Edison base 1008 and a heat sink 1010, an arrangement similar to the embodiment shown in FIG. 1. In this example embodiment, optical element 1002 includes primary exit surface 1012, which has a diameter larger than the base of the diffuser where it is attached to the power supply portion of the lamp. Optical element 1002 has been thermoformed in this example. Also in this example embodiment, the diffuser is "faceted" and includes multiple, optional flat surfaces 1060. Thus, optical element or diffuser 1002 is substantially frustoconical, but faceted and inverted from that shown in previous illustrations. Finally, optical element 1002 includes remote wavelength conversion material 1064, for example, a phosphor or quantum dots. This material provides additional or alternative wavelength conversion to the material that may be included in individual LED packages within the LED assembly. The wavelength conversion material may also be impregnated in the diffuser or provided in such a way as to form layers of wavelength conversion material and diffusion material that could occur in any order.

Features of the various embodiments of the LED lamp described herein can be adjusted and combined to produce an LED lamp that has various characteristics, including, in some embodiments, a lamp that meets or exceeds one or more of the product requirements for an L prize category. For example, the lamp may have a CRI of about 80 or more, 85 or more, 90 or more, or 95 or more. The lamp may have a luminous efficacy or efficiency of at least 150 lumens per watt, at least 160 lumens per watt or at least 165 lumens per watt. The lamp may have an efficiency of 170 lumens per watt, 175 lumens per watt, or 180 lumens per watt. In some embodiment, the lamp may have a luminous efficacy of at least 300 lumens per watt. In other embodiments, the lamp may have a luminous efficacy of between about 165 and about 180 lumens per watt or between about 165 and 175 lumens per watt.

As previously mentioned, the L Prize specification defines various characteristics a solid-state lamp must have to qualify for consideration in various prize categories. One recently added category is referred to as the "Twenty-First Century Lamp" prize, intended to recognize a solid state lamp with high efficiency and high light output. Embodiments of the present invention can meet these requirements with an efficiency of at least 150 lumens per watt and a total light output of at least 1200 lumens. In some embodiments the lamp has a total light output of at least 1300 lumens or at least 1350 lumens. In some embodiments, the lamp has a total light output of between 1200 and 1400 lumens per watt, or between 1200 and 1350 lumens per watt. Other requirements for the Twenty-First Century Lamp prize include a color rendering index of at least 90, a coordinated color temperature, also referred to as a color coordinate temperature, between 2800 K and 3000 K, and a lifetime exceeding 25,000 hours. Embodiments of the present invention can meet any or all of these specifications.

Figure 11:
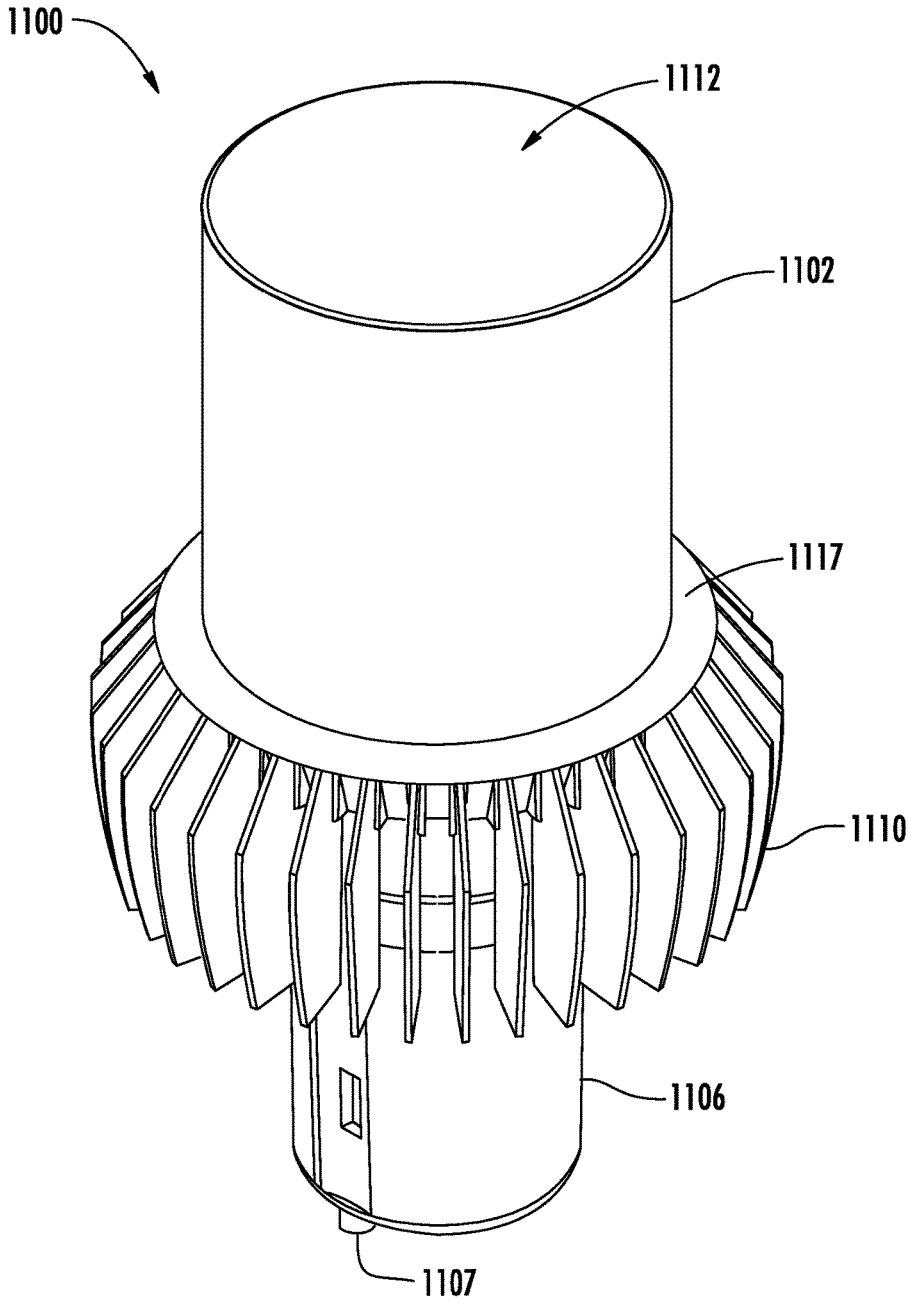
FIG. 11 is a perspective view of a lamp according to another embodiment of the invention.
Figure 12:
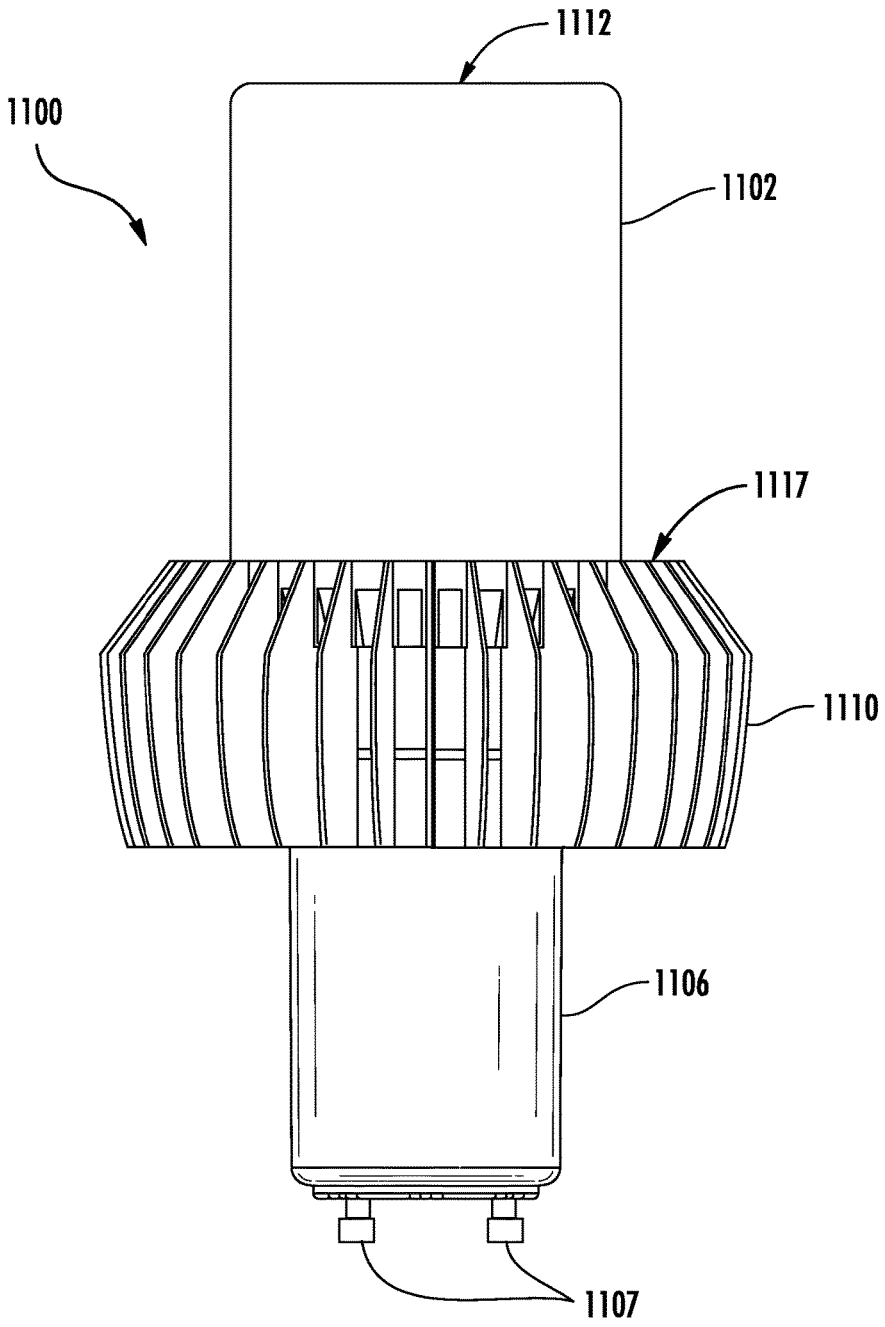
FIG. 12 is a side view of the lamp according to the embodiment pictured in FIG. 7.
Figure 13:
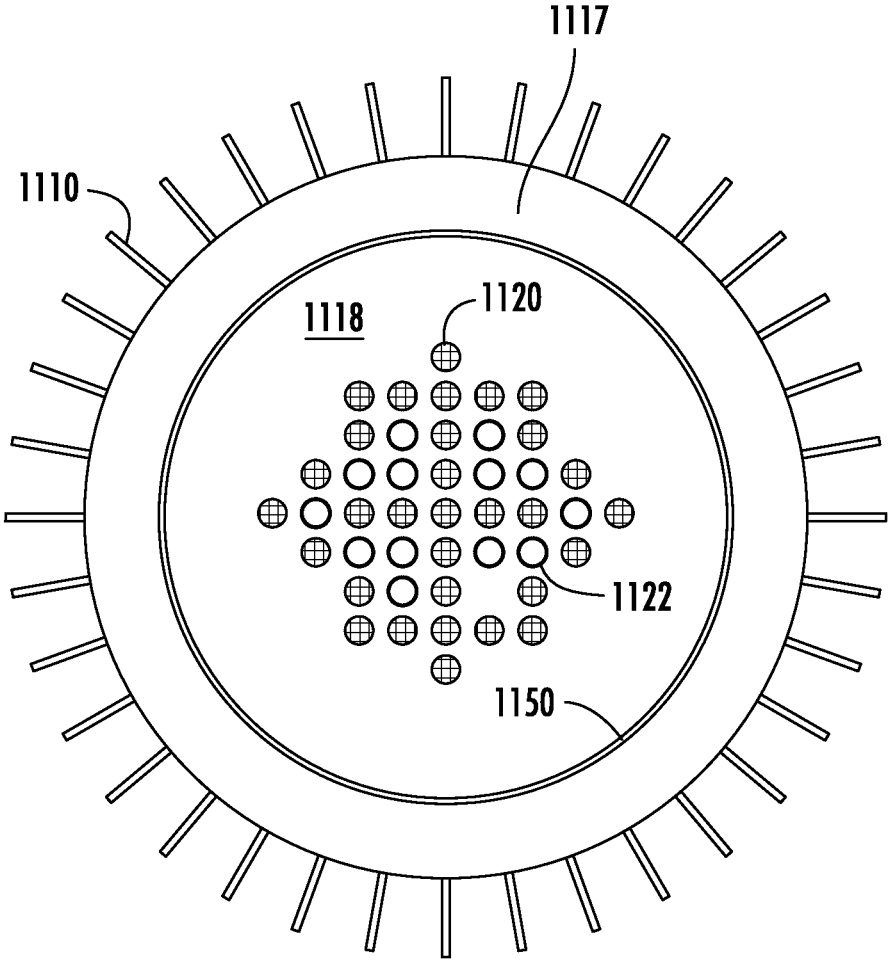
FIG. 13 is a top view of a partially assembled LED lamp according to example embodiments of the invention. More specifically.

FIG. 11 is a perspective view of an LED lamp according to another embodiment of the present invention, FIG. 12 is a side view of this lamp, and FIG. 13 illustrates the lamp from the top with the optical element removed. Lamp 1100 includes an optical element 1102 and contains an LED assembly to be shown in and described with respect to FIG. 13. The LED assembly of the lamp has been interconnected with a power supply in power supply portion 1106 of the lamp. The power supply portion 1106 of the lamp includes the power supply circuitry (not visible) to provide current to the LED assembly. The power supply may also be referred to as a "driver." In one example embodiment, a floating buck converter serves as the driver for the lamp. The particular power supply portion of an LED lamp shown includes a GU24 type base with two connection pins 1107. An Edison base or any other connector could also be used. Pins 1107 are connected to the power supply to provide AC line power to the power supply. Heatsink 1110 is similar to the heatsink shown in FIG. 5, FIG. 6 and FIG. 7. In this example embodiment, heatsink 1110 has a plurality of vertical fins that are painted or coated to be substantially white so that they tend reflect light. The fins are attached to the lamp at the top to provide cooling for the LED assembly and are painted or coated substantially white. The surface of the fins could be specular or diffusive, depending on the lighting characteristics desired. In some embodiments the fins may also provide cooling for the driver. In this example embodiment, the power supply portion 1106*y* of the lamp is a plastic enclosure that is not directly attached to the fins so that it can be inserted into the space inside the fins during manufacture.

The optical element of the example LED lamp of FIG. 11, FIG. 12 and FIG. 13 includes primary exit surface 1112. Lamp 1100 also includes an optical overlay 1117, which is a flat, annular-shaped member adjacent to the top of the heatsink and adjacent to or around the base of the optical element 1102. Optical overlay 1117 can be made of various materials including plastic and metal, and in this example embodiment is substantially white and reflective. The optical overlay can be molded white, coated or painted, and may be specular or diffusive in its reflectivity depending on the particular lighting characteristics desired.

Turning more specifically to FIG. 13, LED assembly 1118 is visible in this view of LED lamp 1100 with optical element 1102 removed. In this example, the LED devices, also called LED packages, used in the LED assembly are portrayed realistically overall while some detail is omitted for clarity. The LED devices are mounted on a circular, copper printed circuit board. LED devices 1120 are blue-shifted yellow (BSY) LED devices, in which blue LEDs are packaged with a yellow phosphor to become BSY light emitters. In example embodiments, LED devices 1120 are square packages 3.45 mm on a side, each including a 1.4 mm square LED chip die. These relatively large chips allow these LEDs to be driven with a relatively low current density, that is, low current per unit of area of the active layer. An LED device that can be used is also disclosed as part of certain embodiments described in U.S. patent application Ser. No. 13/081,013, entitled, "Horizontal Light Emitting Diodes Including Phosphor Particles," filed Jan. 31, 2011, which is incorporated herein by reference. The device described therein is packaged in the same manner as those used in the lamp of the present example, but has a smaller LED chip die. An additional LED device that can be used is described in U.S. patent application Ser. No. 13/312,518, entitled, "Light Emitter Devices and Methods with Reduced Dimensions and Improved Light Output," filed Dec. 6, 2011, which is incorporated herein by reference. Other types of packaged LED devices can be used. LED devices 1122 are red-emitting LED devices, which includes variations such as red-orange emitting devices. These LED devices could, for example, be XPE™ devices from Cree, Inc. of Durham, N.C. in the United States. In this example embodiment, the LED devices are wired as a single string of LEDs with no current taps and connected to the power supply beneath the LED assembly. In some embodiments, at least 12 of each type of color-emitting LED device are used. In the example embodiment shown, 31 BSY-emitting LED devices 1120 and 13 red-emitting LED devices 1122 are used.

Still referring to FIG. 13, optical element 1102 in this embodiment, a cylindrical or cup-shaped diffuser, which can be made of glass or plastic, is fixed to the bottom of the lamp between the LED assembly 1118 and optical overlay 1117 by fastening the optical element into the circular slot 1150. The diffuser or optical element is fastened with adhesive, mechanical fasteners, or any other fastening method, as is the optical overlay. The optical element can be snap fit and is readily replaceable, possibly even in the field. It should be noted that this type of mechanism could be used in any optical element, including the various other ones shown herein. Again, other fastening techniques could achieve a similar result, for example, the optical element could screw into place just inside the optical overlay.

Figure 14:
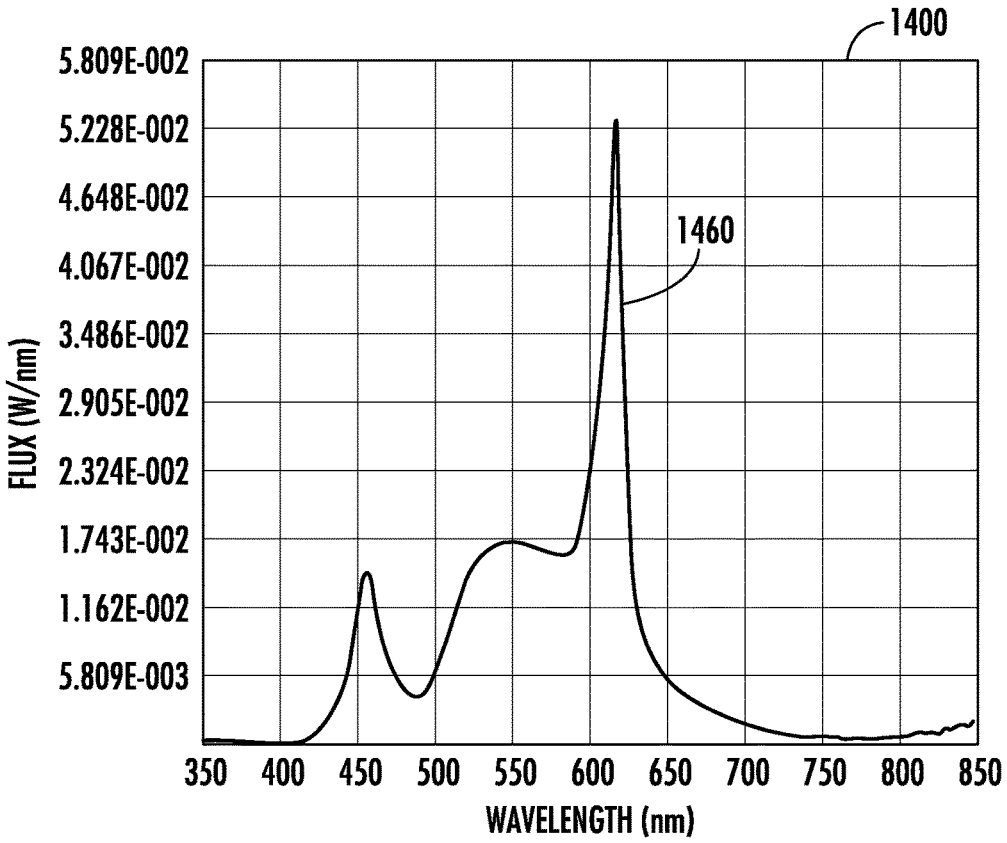
FIG. 14 is a spectral flux graph for the embodiment of the lamp shown in FIGS. 11, 12 and 13.
Figure 15:
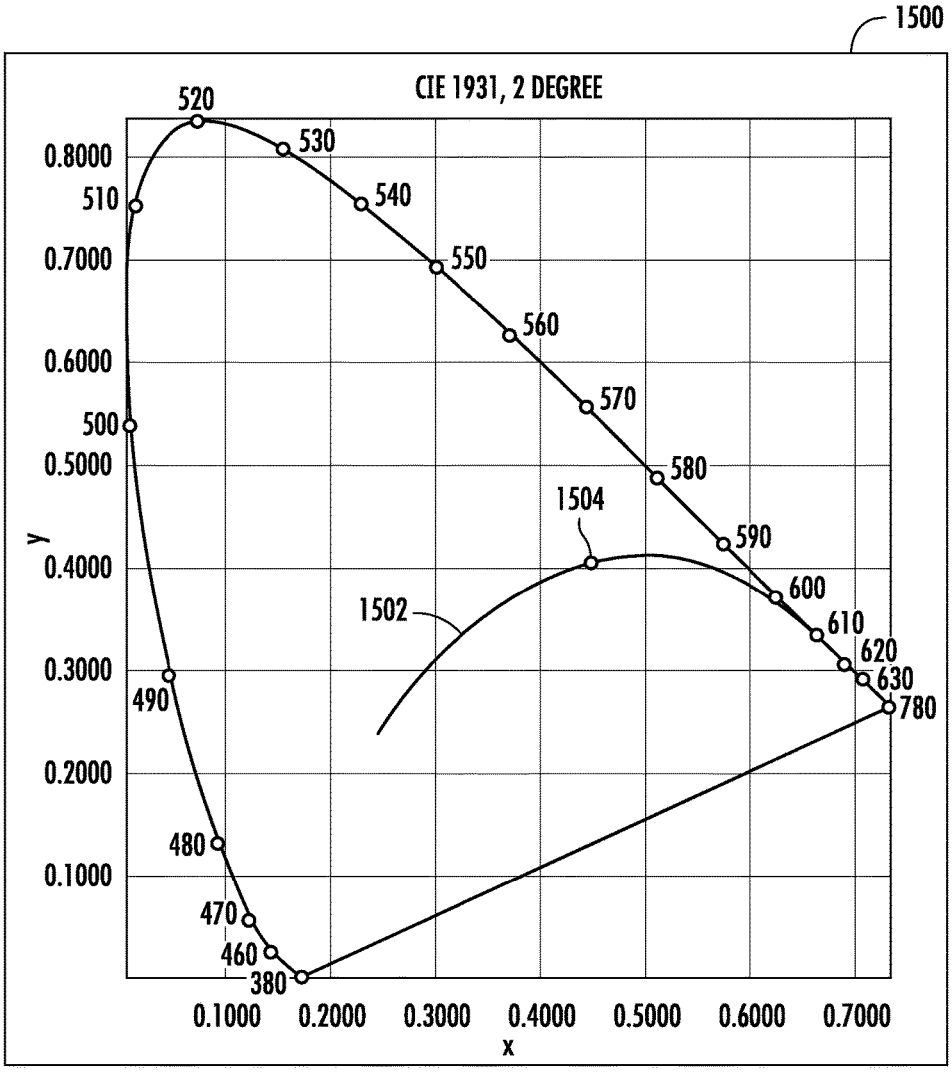
FIG. 15 is a CIE 1931 chromaticity diagram for the embodiment of the lamp shown in FIGS. 11, 12 and 13.

FIG. 14 illustrates a spectral flux graph showing data taken in the testing of an LED lamp like that shown in FIGS. 11, 12 and 13. Graph 1400 shows wavelength on the horizontal axis and flux on the vertical axis. Graph 1400 includes spectral flux curve 1460, which shows a peak at around 610 nm, the dominant wavelength of the red-emitting LED devices used. FIG. 15 illustrates a CIE 1931 chromaticity diagram for the above-mentioned testing. The chromaticity diagram shows a portion 1502 of the MacAdam ellipses, along with the sample point 1504 for the lamp from the above-mentioned tests.

The above-mentioned testing produced additional results on the LED lamp as follows:

Total Luminous Flux: 1258 Lumens
Luminous Efficacy: 170.34 Lumens/Watt
CCT: 3125.5 K
CRI: 90.1
Radiant Flux: 3.698 Watts
Chroma x/Chroma y: 0.4285/0.4017
Chroma u/Chroma v: 0.2462/0.3461
Chroma u'/Chroma v': 0.2462/0.5192
Duv: 0.00027
Input Power: 7.385 Watts
Input Voltage (AC): 120.0 Volts
Input Current 0.109 Amps
Power Factor: 0.566

THD % V/A: 0.16/120.4
Ambient Temp/Humidity: 25.3 C/49%
Stabilization Time: 36 minutes
Operating Time: 40 minutes Although specific embodiments have been illustrated and described herein, those of ordinary skill in the art appreciate that any arrangement which is calculated to achieve the same purpose may be substituted for the specific embodiments shown and that the invention has other applications in other environments. This application is intended to cover any adaptations or variations of the present invention. The following claims are in no way intended to limit the scope of the invention to the specific embodiments described herein.

The invention claimed is:

1. An LED lamp comprising:

a plurality of LEDS, each of the plurality of LEDs comprising an at least 1.4mm square LED chip die;

a diffuser including a cylindrical surface defining a first end and a second end and a primary exit surface through which light exits the LED lamp, the primary exit surface closing the first end of the cylindrical surface and being substantially flat over its entire area, wherein the primary exit surface is spaced between about 1.5 and about 8 inches from the plurality of LEDs; and a flat, reflective, annular-shaped member surrounding and external to the diffuser, the flat, reflective, annular-shaped member being disposed adjacent the second end and being exposed to light emitted from the diffuser to reflect the light;

wherein the lamp produces at least 170 Lumens per Watt.

2. The LED lamp of claim 1 wherein the plurality of LEDS further comprises at least two groups of LEDs, wherein one group, when illuminated, emits light having a dominant wavelength from 435 to 490 nm, and another group, when illuminated, emits light having a dominant wavelength from 600 to 640 nm, one group being packaged with a phosphor, which, when excited, emits light having a dominant wavelength from 540 to 585 nm.

3. The LED lamp of claim 2 wherein the one group, when illuminated, emits light having a dominant wavelength from 440 to 480 nm, the other group, when illuminated, emits light having a dominant wavelength of about 610 nm, and the phosphor, when excited, emits light having a dominant wavelength from 560 to 580 nm.

4. An LED lamp comprising: an LED assembly including at least first and second LEDs operable to emit light of at least two different colors; a cylindrical optical element disposed to receive light from the LED assembly, the optical element including a cylindrical curved surface defining a first end and a second end and a primary exit surface through which light exist the LED lamp, the primary exit surface closing the first end of the cylindrical curved surface and being substantially flat over its entire area, and the primary exit surface spaced at least about 1.5 inches from the LED assembly; and a flat, white reflective, annular-shaped member surrounding and external to the optical element and the LED assembly, the flat, white reflective, annular shaped member being disposed adjacent the second end and being exposed to light emitted from the optical element to reflect the light; wherein the lamp produces at least 170 Lumens/Watt.

5. The LED lamp of claim 4 wherein the first and second LEDs, when illuminated, emit light having a dominant wavelength from 435 to 490 nm and a dominant wavelength from 600 to 640 nm, respectively, and at least one of the first and second LEDs is packaged with a phosphor, which, when excited, emits light having a dominant wavelength from 540 to 585 nm.

6. The LED lamp of claim 5 wherein the first and second LEDs, when illuminated, emit light having a dominant wavelength from 440 to 480 nm, and a dominant wavelength of about 610 nm, respectively and the phosphor, when excited, emits light having a dominant wavelength from 560 to 580 nm.

7. The LED lamp of claim 4 further comprising a heatsink adjacent to the flat, white reflective, annular-shaped member, the heatsink including a plurality of substantially white fins.

8. The LED lamp of claim 7 wherein the primary exit surface is spaced from about 1.5 to about 8 inches away from the LED assembly.

9. The LED lamp of claim 8 further comprising a power supply portion including a power supply in thermal communication with the heatsink and electrically connected to the LED assembly.

10. The LED lamp of claim 9 wherein the LED assembly further comprises: a plurality of red-emitting LED devices; and a plurality of blue-shifted-yellow (BSY) emitting LED devices.

11. The LED lamp of claim 10 wherein the plurality of each of the red-emitting LED devices and BSY-emitting LED devices comprises at least 12 LED devices.

12. The LED lamp of claim 11 wherein the plurality of the red-emitting LED devices comprises 13 LED devices and the plurality of BSY-emitting LED devices comprises 31 LED devices.

13. A method of assembling a high-efficiency LED lamp, the method comprising:

providing an LED assembly comprising a plurality of LEDs mounted on a flat carrier;

connecting the LED assembly to a line-voltage power supply;

providing a heatsink in thermal communication with at least one of the line-voltage power supply and the LED assembly;

installing a flat, white reflective, annular-shaped member adjacent to the heatsink; and installing a cylindrical optical element disposed to receive light from the LED assembly, the optical element including a cylindrical surface defining a first end and a second end and a primary exit surface through which light exits the LED lamp, the primary exit surface closing the first end of the cylindrical surface and being substantially flat over its entire area and being substantially parallel to the carrier over its entire area, the optical element being positioned so that the flat, reflective, white reflective, annular-shaped member is external to and surrounds the optical element adjacent the second end and is exposed to light emitted from the diffuser to reflect the light., the primary exit surface also positioned so that the primary exit surface is spaced at least about 1.5 inches from the LED assembly wherein the lamp produces at least 170 Lumens/Watt.

14. The method of claim 13 wherein the primary exit surface is spaced from about 1.5 to about 8 inches away from the LED assembly.

15. The method of claim 14 wherein the providing of the LED assembly further comprises:

providing first and second LEDs operable to emit light of at least two different colors; and packaging one of the first and second LEDs with a phosphor.

16. The method of claim 15 wherein the first and second LEDs, when illuminated, emit light having a dominant wavelength from 435 to 490 nm and a dominant wavelength from 600 to 640 nm, respectively, and the phosphor, when excited, emits light having a dominant wavelength from 540 to 585 nm.

17. The method of claim 16 wherein the first and second LEDs, when illuminated, emit light having a dominant wavelength from 440 to 480 nm, and a dominant wavelength of about 610 nm, respectively and the phosphor, when excited, emits light having a dominant wavelength from 560 to 580 nm.

18. An LED lamp comprising:

a plurality of LEDs mounted on a flat carrier, wherein the plurality of LEDS comprises at least two groups of LEDs, wherein one group, when illuminated, emits light having a dominant wavelength from 435 to 490 nm, and another group, when illuminated, emits light having a dominant wavelength from 600 to 640 nm, one group being packaged with a phosphor, which, when excited, emits light having a dominant wavelength from 540 to 585 nm, the plurality of LEDs each having a square area of approximately 2.0 $mm^2$;

a heat sink thermally coupled to the plurality of LEDs;

a diffuser including a curved cylindrical surface defining a first end and a second end and a primary exit surface through which light exits the LED lamp, the primary exit surface closing the first end of the curved cylindrical surface and being substantially parallel to the carrier over its entire area such that a primary portion of the light from the plurality of LEDs reflects off of the cylindrical surface and exits the lamp through the primary exit surface, the primary exit surface spaced at least 1.5 inches from the LED assembly; and a flat, reflective, annular-shaped member surrounding and external to the diffuser, the flat, reflective, annular-shaped member being disposed adjacent the second end for reflecting light emitted from the diffuser, whereby the lamp produces at least 1200 Lumens with a CRI of at least 90 with a luminous efficacy of at least 170 Lumens per Watt.

* * * * *